United States Patent [19]

Nagata et al.

[11] Patent Number: 4,556,096

[45] Date of Patent: Dec. 3, 1985

[54] METHOD FOR THE PREPARATION OF A SPONGY METALLIC BODY

[75] Inventors: Sumio Nagata, Tosu; Kazuhide Kanaiwa; Takashi Ichikawa, both of Nagoya, all of Japan

[73] Assignees: Director-General of the Agency of Industrial Science and Technology, Tokyo; Shachihata Kogyo K.K., Aichi, both of Japan

[21] Appl. No.: 690,889

[22] Filed: Jan. 14, 1985

[51] Int. Cl.[4] ..... B22D 29/00; B22D 25/00

[52] U.S. Cl. ..... 164/79; 164/132; 164/529; 164/522

[58] Field of Search ..... 164/79, 132, 98, 529, 164/522

[56] References Cited

FOREIGN PATENT DOCUMENTS 2313158 12/1976 France ..... 164/132

*Primary Examiner*—Kuang Y. Lin

*Attorney, Agent, or Firm*—Brisebois & Kruger

[57] ABSTRACT

The invention provides an improved method for the preparation of a porous spongy body of a metal or alloy having an open cell structure. The basic principle of the method is the pressurized casting of a melt of the metal or alloy with a preheated powder compact of an inorganic compound soluble in a solvent to fill up the pores and dissolving away the inorganic compound with a solvent after solidification of the melt. The improvement comprises forming interconnections bridging the particles in the powder compact and, different from conventional methods in which the preheating temperature is higher than the solidification temperature of the melt, preheating the powder compact at a temperature lower than the solidification temperature of the melt but higher than a critical preheating temperature defined as a function of the solidification temperature of the melt, latent heat of solidification of the melt, density of the metal or alloy, volume fraction of the inorganic compound in the powder compact under casting, specific heat of the inorganic compound and true density of the inorganic compound.

11 Claims, 7 Drawing Figures

METHOD FOR THE PREPARATION OF A SPONGY METALLIC BODY

BACKGROUND OF THE INVENTION

The present invention relates to a method for the preparation of a spongy metallic body or, more particularly, to a method including the step of pressurized casting for the preparation of a spongy metallic body having a high porosity with intercommunicating open cells and useful as a functional material in various fields of applications.

As is known, porous metallic bodies in general are classified into those of closed-cell structure, in which each of the void cells is isolated from the others with the surrounding metal walls not to permit permeation or penetration of gases and liquids through the body, and those of open-cell structure, in which each of the cells intercommunicates with the others to permit permeation or penetration of gases and liquids through the body like a sponge and the porous metallic bodies of each class are employed in the fields in which their respective characteristic properties are utilizable. Spongy metallic bodies of open-cell structure are useful as a high-functional material in various fields of applications such as oilless bearings, filter members, heat-exchange elements, electrodes, catalysts, reservoirs of specific substances and the like as only a few of the examples in which absorption or penetration of gases or liquids is essential.

The most conventional method for the preparation of a spongy metallic body is the so-called powder metallurgical process in which a metal powder is shaped by molding and the molded green body is subjected to sintering. One of the problems in such a sintering method is the limited porosity of the sintered metallic body. Since the packing density or space impregnation of the metal particles in the molded green body is the predominant determinant of the porosity in the finished sintered body, namely, the porosity of the spongy metallic body obtained by this method can rarely exceed about 40%. In addition, the open-cell structure of such a spongy metallic body is subject to deterioration by a mechanical working of the body such as cutting, grinding and plastic deformation to always cause clogging or collapsing of the open cells resulting in the decreased permeability of gases or liquids. This problem necessarily presents a limitation in the shapes of the products that the shape of the final product in most cases is a mere reproduction of the shape of the molded green body so that sintered products of complicated forms can hardly be manufactured by this method.

An alternative method for the preparation of a spongy metallic body is disclosed, for example, in Japanese Patent Publication, 39-3652 according to which spongy metallic bodies of a relatively high porosity could be obtained. In this method, a steel mold is filled with a powder of sodium chloride to form a powder compact and a melt of a metal having a relatively low melting point, such as aluminum, zinc and lead, is poured over the powder compact preheated at a suitable temperature under pressurization so as to penetrate into the interstices of the sodium chloride particles followed by cooling to effect solidification of the molten metal and to form a composite body of the metal as the matrix and the sodium chloride particles as the dispersant which is then leached away in water to leave the metallic matrix in a spongy form.

In this method, however, the metal should have a melting point lower than that of sodium chloride of 801° C. and the shape of the product is also under limitation because the method necessarily involves the step of compacting of the sodium chloride powder under pressure so that the method is not suitable for the manufacture of spongy metallic bodies of complicated forms or large sizes. According to the teaching of the above recited Japanese patent, in addition, the preheating temperature of the sodium chloride compact should always be higher than the solidification temperature of the molten metal pressurized thereinto. As is described below, a very fatal defect is caused therefrom in practicing the pressurization of the molten metal into the powder compact of sodium chloride. This is presumably the principal reason for the fact that even a period of two decades or longer is not long enough for the practical development of the patented method in the industrial production of spongy metallic bodies.

When the pressurized casting method is applied to the preparation of a composite body composed of a metal matrix and a powder compact as a precursor of a spongy metallic body, it is a prerequisite to prevent premature solidification of the molten metal in the narrow interstices of the powder particles to clog the passage of the melt in order that the melt is able to flow threading the interstices and to reach the core portion of the body. It is therefore reasonable in this regard that the above mentioned Japanese patent teaches a preheating temperature higher than the solidification temperature of the metal melt. Such a preheating condition, however, can afford no solution of the problems given below. Namely, the melt under a pressure of at least several tens of $kg/cm^2$ is readily pressurized into the narrow clearance between the metal mold and the plunger or the small air escape in the mold and violently ejected therethrough. When the plunger is further thrusted into the mold under an increasing pressure, the plunger eventually comes into contact with and pressing of the powder compact to cause destruction or plastic deformation thereof. Such undesirable phenomena can be avoided only by interrupting the pressurization immediately when leak of the melt takes place but interruption of pressurization naturally results in the loss of the desired effect of solidification under pressurization so that the thus obtained composite bodies are always not free from a number of portions unfilled with the metal and satisfactory products can hardly be obtained. Furthermore, intentional or accelerated cooling of the mold from outside is essential in order to effect efficient solidification of the molten metal as a result of the high preheating temperature so that the productivity of the process is not always sufficiently high.

The above described problems can be solved altogether when the preheating temperature of the powder compact is lower than the solidification temperature of the molten metal so as to utilize the powder compact per se and the mold as a heat sink, i.e. escape for the heat evolved by the solidification of the melt, although, needless to say, the preheating temperature cannot be too low in order to avoid the premature solidification of the melt to clog the interstices for the passage of the melt resulting in incomplete infiltration of the melt through the powder compact as is mentioned above.

SUMMARY OF THE INVENTION

It is therefore an object of the present invention to provide a novel method for the preparation of a spongy metallic body of an open-cell structure with intercommunicating cells including the step for the preparation of a composite body of a metal matrix and a powder compact freed from the above described problems and disadvantages in the prior art methods.

The method of the invention has been completed as a result of the extensive investigations undertaken by the inventors under a guide principle that the optimum preheating temperature of the powder compact should be somewhere between the solidification temperature of the molten metal and a certain lower limit below which clogging of the particle interstices may take place by the premature solidification of the melt. Such a lower limit of the preheating temperature may be called the critical preheating temperature.

Thus, the method of the present invention for the preparation of a spongy metallic body of high porosity having an open-cell structure comprises the steps of:

(a) compacting a powder of an inorganic compound soluble in at least one solvent and having a particle size distribution in the range from 10 to 500 μm into a form of powder compact;

(b) forming interconnections at least partly bridging the particles in the powder compact to form a porous integral mass;

(c) preheating the porous integral mass at a preheating temperature $T^P$ in °C. which is lower than the melting point of the inorganic compound and between the solidification temperature of the undermentioned metal or alloy $T^M$ in °C. and a critical preheating temperature $T^C$ in °C. expressed by the equation $$T^{C=TM}-0.25(H^M \cdot D^M/V^{P \cdot CP}]D^P), \quad (I)$$

in which $H^M$ is the latent heat of solidification of the metal or alloy in calories/g, $D^M$ is the density of the metal or alloy in g/cm$^3$, $V^P$ is the volume fraction or space impregnation of the particles of the inorganic compound in the porous integral mass, i.e. packing density, $C^P$ is the specific heat of the inorganic compound in calories/g.°C. and $D^P$ is the true density of the inorganic compound in g/cm$^3$;

(d) filling the pores of the porous integral mass with a melt of a metal or alloy, preferably, under pressurization to form a metal-impregnated mass;

(e) cooling the metal-impregnated mass to solidify the melt of the metal or alloy and to form a composite body of the inorganic compound and the solidified metal or alloy; and (f) removing the inorganic compound from the composite body by leaching out with a solvent capable of dissolving the inorganic compound to leave the solidified metal or alloy in a spongy form.

In particular, the above mentioned step (b) for forming the interconnections between the particles of the inorganic compound can be performed in several different ways. For example, the powder compact may be subjected to sintering by heating at a temperature somewhat lower than the melting point of the compound to form bridges at the contacting points between the particles giving a porous integral mass. Alternatively, the powder compact of the inorganic compound is wetted with a saturated solution of the same compound as the solute followed by drying the wet powder compact to precipitate the solute at the interstices between the particles so that the particles are interconnected together by the thus precipitated compound to form a porous integral mass.

It is proposed further that the porosity of the spongy metallic body obtained by the above described method can be decreased to a controlled extent by an isotropic or anisotropic mechanical compression with an object to impart the spongy metallic body with improved mechanical properties.

DETAILED DESCRIPTION OF THE PREFERRED EMBODIMENTS

The metal or alloy, which is naturally solid at room temperature, to be processed into a spongy metallic body by the above described inventive method is not particularly limitative according to the particular intended applications of the body and includes, for example, cast iron, lead, zinc, tin, aluminum, magnesium, gold, silver, copper, nickel and others as well as alloys thereof.

The inorganic compound formed into a powder compact in the above mentioned step (a) is also not particularly limitative provided that the compound is thermally stable against decomposition and the melting point thereof is substantially higher than the critical preheating temperature calculated according to the above given equation (I) for the combination of the powder compact of the compound and the metal or alloy and, preferably, higher than the melting point of the metal or alloy and that it is soluble in at least one solvent. The solvent here implied is not limited to those of a particular class of inorganic and organic solvents including water, aqueous solutions of alkalis and acids, alcohols, acetone, dimethylformamide and the like but the solvent should be inert to the metal or alloy. In this regard, for example, an inorganic compound soluble only in an aqueous acid solution is undesirable when the metal or alloy is reactive with the acid. Particularly preferable inorganic compounds are those soluble in water and many of the salts of alkali and alkaline earth elements are satisfactory though not limited thereto. Several examples of usable inorganic compounds include sodium chloride, potassium chloride, sodium nitrite, barium chloride, tin (II) chloride, zinc chloride, copper (II) chloride, magnesium chloride, magnesium sulfate, potassium phosphate and the like.

The above mentioned inorganic compound should be in a powdery form and it is preferable in the invention that the powder of the inorganic compound should have a particle size distribution in the range from 10 to 5000 μm. When no powder product of the preferable particle size distribution is available on the market of the desired inorganic compound, it is readily prepared by melting the inorganic compound and casting the melt into a mold to form an ingot which is then pulverized and sized by screening using a set of sieves having suitable mesh openings.

The thus prepared powder of the inorganic compound is then compacted into a desired form of powder compact. This step is conveniently performed by filling a heat-resistant mold of the desired form with the powder by tapping. It is not always necessary and optional to intentionally compress the powder compact under a pressure depending on the desired porosity of the final product.

Figure 1:
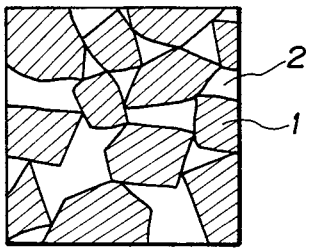
FIG. 1 is a schematic illustration of a cross section of a powder compact in which particles are contacted each with the others point-to-point.
Figure 2:
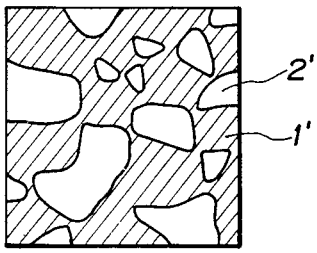
FIG. 2 is a schematic illustration of a cross section of a porous integral mass of the powdery inorganic compound in which particles are interconnected through bridges having substantial dimensions.

In the next place, the powder compact formed in the above described manner is subjected to a treatment for the formation of interconnections between the particles of the inorganic compound to at least partly bridge them so that the powder compact is now an integral but porous mass. This treatment can be performed in several different ways of which one is the sintering method. Thus, the powder compact formed in the heat-resistant mold as mentioned above is heated as such at a temperature somewhat lower than the melting point of the inorganic compound for a suitable length of time so that interconnections are formed between the particles at the contacting points. FIGS. 1 and 2 are each a schematic cross sectional illustration of the powder compact before and after sintering. As is readily understood, the powder compact formed of the particles 1 and the void cells 2 in FIG. 1 is converted into a porous integral mass in FIG. 2 formed of the interconnected particles 1' and the still intercommunicating void cells 2'. Care should be taken by avoiding an excessively high sintering temperature or an excessively long sintering time to ensure that all of the void cells 2' in FIG. 2 are not closed in a so-called oversintered state but remain intercommunicated each with the others since such a closed cell cannot be filled with the molten metal or alloy in the following step. A porosity of about 15% is the lower limit below which the sintered body is in the oversintered state containing certain volumes of closed cells. The porosity of the sintered body should preferably be in the range from 15 to 50% or, in the other words, the packing density should be in the range from 50 to 85%. Oversintering is undesirable also in view of the great shrinkage of the body in comparison with the powder compact before sintering. Although some of the void cells 2' in FIG. 2 are seemingly isolated and closed in this two-dimensional illustration of the cross section, they are still kept as intercommunicated each with the others at least in the direction perpendicular to the plane of the cross section.

As is mentioned before, an alternative method is proposed to the above described method of sintering for the formation of interconnections between the particles of the powder compact. In this alternative method, the interconnections between the particles in the powder compact are formed, in place of the sintering of the particles per se at the contacting points, by the precipitation of the inorganic compound from a saturated solution thereof. Thus, the powder compact of the inorganic compound prepared in the step (a) is infiltrated with a saturated solution of the same inorganic compound under pressure or suction so that the surfaces of the particles are wet with the solution. It is of course optional that, instead of wetting of the preshaped powder compact with the saturated solution, the particles of the inorganic compound are wetted in advance with the saturated solution by spraying or admixture prior to compacting into a powder compact in a mold of a heat-resistant material. In this case of pre-wetting, it is preferable that the powder compact in the mold is formed by compression under a pressure of, for example, 1 to 20 $kg/cm^2$ rather than by a technique of mere tapping. Care must be taken to avoid collapsing of the particles under an excessively large compressive force. The powder compact thus wetted with the saturated solution of the inorganic compound is then dried by heating under normal pressure or reduced pressure so that the solute compound is precipitated as the solvent is evaporated at the interstices between the particles to form interconnecting bridges therebetween. The porosity of the thus formed porous integral mass also should be preferably in the range from 15 to 50% so that the packing density of the powder compact should be adequately controlled by taking into consideration the increment due to the precipitation of the inorganic compound from the saturated solution thereof on the particle surfaces.

Figure 3:
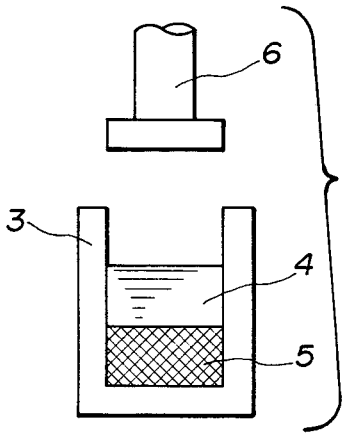
FIG. 3 is a schematic cross sectional view of a device for pressurizing a melt of metal or alloy to impregnate a porous body therewith

The next coming step is the impregnation of the porous integral mass of the inorganic compound with a molten metal or alloy to fill up the pores of the mass. The impregnation should be performed, preferably, under a pressure of up to, for example, 1000 $kg/cm^2$ by the technique of pressurized casting with the porous integral mass of the inorganic compound preheated at a preheating temperature between the solidification temperature of the metal or alloy and the critical preheating temperature given by the equation (I). An apparatus used for the pressurized casting is schematically illustrated in FIG. 3 by a vertical cross section, in which the porous integral mass 5 of the inorganic compound is placed on the bottom of the mold 3 made of a heat-resistant material such as carbon and a high-melting metal, e.g. steel, and a melt of the metal or alloy 4 is poured to cover the porous mass 5 of the inorganic compound and then the plunger 6 is thrusted down into the mold 3 so as to cause forcible intrusion of the molten metal or alloy 4 into the pores of the porous integral mass 5 of the inorganic compound. The pressure given to the molten metal or alloy 4 by the descending plunger 6 should be large enough to overcome the resistance against the flow of the molten metal or alloy 4 threading through the interstices of the particles in the mass 5 to fill up the pores as completely as possible. The necessary pressure on the melt 4 naturally depends on the pore size in the porous mass 5, viscosity of the melt 4 and other factors but a pressure of about 30 $kg/cm^2$ or larger is usually sufficient.

The most essential scope of the inventive method is in the control of the preheating temperature $T^P$ of the porous integral mass of the inorganic compound. The preheating temperature $T^P$, which is naturally lower than the melting point of the inorganic compound, should be lower also than the solidification temperature of the molten metal or alloy in contrast to the conventionally accepted techniques in which the preheating temperature is higher than the solidification temperature of the molten metal or alloy in order to avoid premature solidification of the melt to cause clogging of the passway of the melt threading the interstices of the particles though with a very serious problem described above left unsolved. The lower limit of the preheating temperature $T^P$ is the critical preheating temperature $T^C$ defined by the equation (I) given above as a function of $T^M$, $H^M$, $D^M$, $V^P$, $C^P$ and $D^P$, each of the symbols having the meaning defined above. Useful values of these parameters for various kinds of metals, alloys and inorganic compounds are available in several authentic handbooks including, for example, Metals Handbook, 8th ed., volume 4 by the American Society of Metals, 1961, and Smithells Metals Reference Book, 6th ed., Butterworths Pub., 1983. When the preheating temperature $T^P$ of the porous mass is equal to or lower than the critical preheating temperature $T^C$, the drawback of the premature solidification of the melt is sometimes unavoidable. The temperature of the melt of the metal or alloy with which the powder compact is impregnated under pressure should be higher by 100° to 200° C. than the solidification temperature thereof but should be lower than the melting point of the inorganic compound forming the powder compact. When the temperature of the melt is too low, premature solidification of the melt takes place to clog the passway of the melt.

The porous integral mass of the inorganic compound thus impregnated with the molten metal or alloy is then cooled down to a temperature lower than the solidification temperature of the molten metal or alloy so that the whole mass in the mold is converted into a composite body composed of the inorganic compound forming a skeleton and the solidified metal or alloy filling the pores.

The composite body thus obtained is then subjected to a treatment for the removal of the inorganic compound therefrom to leave the phase of the metal or alloy in a spongy form. If desired, the composite body is mechanically worked prior to this step by cutting, slicing, grinding or the like to be imparted with a desired form. The removal of the inorganic compound from the composite body is performed by leaching out, i.e. dissolving away, the compound from the body freed from the crust by use of a solvent capable of dissolving the compound as a leaching liquid. Namely, the solvent should be water when the inorganic compound is soluble in water such as sodium chloride, barium chloride and the like. A sufficiently large velocity of leaching can be obtained by merely keeping the composite body in running water when the inorganic compound has a relatively large solubility in water although the overall length of time for the complete removal of the inorganic compound may depend on the dimensions and porosity structure of the composite body. The velocity of leaching can be increased by using a hot solvent, e.g. hot water, as the leaching liquid or by performing the leaching process under ultrasonic waves.

Figure 4:
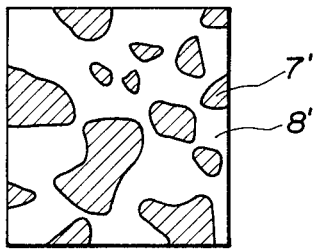

When leaching of the inorganic compound out of the composite body is complete, the body is taken out of the leaching liquid and dried by heating or under reduced pressure according to need to give the final product of the spongy metallic body. FIG. 4 schematically illustrates a cross section of the thus obtained spongy metallic body composed of the spongy skeleton of the metal or alloy 7' leaving the void space 8' intercommunicating throughout the body. This figure is, so to say, a negative reproduction of the figure depicted in FIG. 2 because the void space 2' in FIG. 2 is now occupied by the metal or alloy 7' in FIG. 4 while the space 1' occupied by the inorganic compound in FIG. 2 is the void space 8' in FIG. 4.

Figure 5:
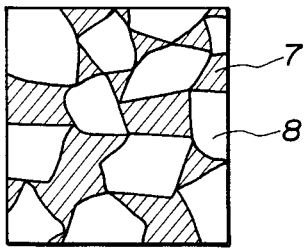
FIGS. 4 and 5 are each a schematic illustration of a porous metallic body obtained by casting a metal melt with the powder compact or porous integral mass of powder illustrated in FIG. 2 or FIG. 1, respectively.

FIG. 4 is contrastable with FIG. 5 which is a schematic illustration of a cross section of a similar spongy metallic body composed of the metallic skeleton 7 leaving the void space 8. In this case, however, the pressurized casting of the molten metal or alloy has been performed by omitting the step for the formation of interconnections between the particles of the inorganic compound leaving the particles in a condition of point-to-point contact as is illustrated in FIG. 1 in clear contrast to FIG. 2 in which the particles of the inorganic compound are interconnected through bridges of substantial dimensions or in a condition of plane-to-plane contact. Thus, FIG. 5 is again, so to say, a negative reproduction of FIG. 1. As is understood from the comparison of these figures, the velocity of leaching of the inorganic compound out of the composite body is much larger in the structure of bridged particles as in FIG. 2 or 4 than in the structure of the point-contacting particles as in FIG. 1 or 5 so that the inorganic compound can be removed from the composite body more rapidly and more completely in the inventive method.

The method of the present invention is applicable to any combination of the soluble inorganic compound and the metal or alloy provided that the above described requirements can be satisfied although it is a desirable condition that the inorganic compound should have a melting point as high as possible in order that the inorganic compound can be used for the preparation of a spongy body of a metal or alloy having a relatively high melting point. In this connection, barium chloride melting at 962° C. is one of the inorganic compounds having the highest melting points among those which satisfy the other requirements including the inexpensiveness. Following is a tabulation of the critical preheating temperatures $T^C$ in °C. calculated for several kinds of metals and alloys and for three different packing densities or space impregnations $V^P$ at 60%, 70% and 80% of the inorganic compound in the porous integral mass thereof when the inorganic compound is barium chloride.

| Metal or alloy | Packing density, % | | |
|---|---|---|---|
| (melting point, °C. | 60 | 70 | 80 |
| Tin (231.9) | 142 | 155 | 164 |
| Zinc (419.5) | 253 | 277 | 295 |
| Aluminum (660.1) | 452 | 481 | 504 |
| Copper (1083) | 710 | 763 | 803 |
| Cast iron (1147) | 796 | 846 | 883 |
| Nickel (1453) | 936 | (1010) | — |
| Iron (1536) | (1110) | — | — |

Needless to say, no spongy metallic body of the invention having the indicated value of the packing density converted to the value of porosity can be obtained with the combination of barium chloride and the metal or alloy when the calculated critical preheating temperature $T^C$ is higher than the melting point 962° C. of barium chloride. For example, the maximum porosity of a porous spongy body of nickel prepared according to the inventive method is somewhere between 60% and 70% when the soluble inorganic compound is barium chloride.

As is understood from the above description, the present invention provides an easy method for the preparation of porous spongy bodies of various kinds of metals and alloys having a porosity reaching 50 to 85%, i.e. twice to thrice larger than that of similar spongy metallic bodies obtained by any conventional methods.

Further, the method of the present invention is advantageous in several other respects described below.

(1) The powder of the soluble inorganic compound can be readily and accurately sized so that the pore diameter of the finally obtained product of the porous spongy metallic body can be controlled according to desire.

(2) The configuration of the pores in the spongy metallic body products is controllable by adequately selecting the particle form of the powder of the inorganic compound.

(3) When the porous integral mass of the inorganic compound is provided with an opening or notch, the product of the spongy metallic body is provided with a solid, i.e. non-porous, portion corresponding thereto which is obtained when integral casting is performed with an insert of the form such as a rod, tube, partition board and the like although it is of course optional that the porous integral mass of the inorganic compound is actually provided in advance with such a metallic insert of a form hardly obtained by providing an opening or notch in the porous integral mass of the inorganic compound such as a wire netting.

(4) When the porous integral mass of the inorganic compound is prepared by the process of wetting a powder compact with a saturated solution of the same compound, the step of sintering can be entirely omitted contributing to a great saving of heat energy required for sintering.

(5) The soluble inorganic compound can be removed by leaching more rapidly and more completely than in the prior art methods. The inorganic compound thus leached out can of course be recycled and re-used.

(6) A guide principle is given for the advantageous preparation of a porous spongy body of a metal or alloy having a high melting point, such as cast iron, by using an inorganic compound which may not have a melting point higher than that of the metal or alloy.

(7) The inventive method is readily applicable without particular problems to those metals of which porous spongy metallic bodies can hardly be obtained by the powder metallurgical method, such as aluminum and magnesium.

By virtue of the above described features and advantages, the porous spongy metallic bodies prepared according to the invention are usable not only for the applications in the fields where similar spongy metallic bodies have been used somehow though with problems but also for the applications in the fields where the use of a porous spongy metallic body has never been contemplated due to the unsatisfactorily low porosity or other defects and disadvantages in the prior art products of spongy metallic bodies. Some of the applications of the porous spongy metallic bodies prepared according to the inventive method include the materials for elements in heat exchangers, filter elements, catalysts and the like for which a large specific surface area is essentially important. Further, the spongy metallic bodies can be used for the manufacture of various kinds of ink-absorptive stationery and printing goods including inking rollers, printing types as in typewriters, stamps and ink pads for stamps, pen tips in writing tools and the like as well as wicks and burning aid mantles in oil stoves, long-life oilless bearings, i.e. bearings pre-impregnated with a lubricating oil, and metal molds with gas-releasable walls by utilizing the liquid absorption by the capillary action and gas permeation. The porous spongy metallic bodies in a form of a board is also useful as a sound-insulating building material. The porous spongy metallic bodies used in the above mentioned applications should not necessarily be uniform in respect of the porosity of the body but the porosity in a portion of a body can be different from the porosity of another portion of the same body. Such a multi-porosity spongy metallic body can be prepared by using powders of the soluble inorganic compound having different particle sizes or by controlling the distribution of the packing density in the powder compact formed thereof.

The porosity of the porous spongy metallic body obtained in the above described method can be further modified or decreased when the spongy body is mechanically compressed anisotropically or isotropically so as to be imparted with a finer pore structure and improved mechanical properties as well as increased heat resistance. Such a compression treatment can be performed by use of a mechanical press such as a universal testing machine or an isotropic hydraulic press such as a rubber press under a pressure of, for example, 100 to 1000 kg/cm$^2$ depending on the desired extent of porosity modification. By this compression, the porosity and pore diameter of the porous spongy metallic body are anisotropically or isotropically decreased but the intercommunicating pore structure before compression is retained as such without collapsing of the pores so that the usefulness of the spongy body is not affected at all.

Accordingly, it is sometimes advantageous that a porous spongy metallic body having a porosity of, for example, 70% or larger, somewhat larger than the finally desired porosity, is prepared according to the method of the invention and the body is subsequently compressed under a controlled condition so that the porosity of the body is decreased to a desired value smaller than the initial value of, for example, 70%. It is of course possible or optional that only a portion of a single spongy body is subjected to compression, the other portions being left uncompressed. It has been a quite unexpected discovery that the intercommunicating pore structure is safe from collapsing or blocking even by the anisotropic or isotropic compression of the body partially or as a whole to give a spongy metallic body having a controlled porosity and improved mechanical properties.

Following are the examples to illustrate the method of the present invention in more detail but not to limit the scope of the invention in any way.

EXAMPLE 1

A powder of sodium nitrite having a particle size distribution in the range from 350 to 590 μm was prepared by melting sodium nitrite followed by solidification, crushing and screening. A cylindrical graphite vessel having an inner diameter of 25 mm and a depth of 30 mm was filled with 18 g of the sodium nitrite powder by tapping and the powder was heated at 270° C. in air for 5 hours to give a cylindrical sintered body of the salt having a diameter of 23 mm and a height of 28 mm corresponding to a packing density or space impregnation of 70%.

This sintered body of sodium nitrite was put into a mold of cast iron having an inner diameter of 30 mm and a depth of 50 mm and preheated at 150° C. in an electric oven. The critical preheating temperature in this case calculated for the above mentioned packing density and tin used in the subsequent casting was 135° C. When the whole volume of the sintered body had reached the preheating temperature, a sufficient volume of molten tin (melting point 232° C.) heated at 350° C. was poured into the mold to cover the sintered body and compressed with a plunger to give a pressure of 30 kg/cm$^2$ until the pores of the sintered body were fully filled with the molten metal. After cooling to solidify the molten tin, the composite body of sodium nitrite and tin was taken out of the mold and, after mechanically removing the crusting layer of tin, the sodium nitrite was leached away by washing in running water followed by drying. The thus obtained porous spongy body of tin had a porosity of 74%.

EXAMPLE 2

A graphite vessel having an inner diameter of 30 mm and a depth of 100 mm was filled by tapping with 90 g of a granular sodium chloride powder having a particle size distribution in the range from 1190 to 1680 μm and the sodium chloride compact was heated at 800° C. in air for 3 hours to give a cylindrical sintered body having a diameter of 29 mm and a height of 98 mm corresponding to a packing density of 60%.

The sintered body of sodium chloride was put into a mold of cast iron having an inner diameter of 30 mm and a depth of 120 mm and preheated at a temperature of 480° C. The critical preheating temperature calculated for the above mentioned packing density of the salt and the aluminum alloy used in the subsequent casting described below was 410° C. When the whole volume of the sintered body had reached the preheating temperature, a melt of a 12% Si-aluminum alloy heated at 700° C. was poured into the mold and pressurized in the same manner as in Example 1 so as to impregnate the porous sintered body of the salt with the melt. After cooling to solidify the melt, the composite body of the salt and the alloy was taken out of the mold and, after mechanically removing the crusting layer of the alloy, the salt was leached away by washing in running water and then under ultrasonic waves followed by drying. The thus obtained porous spongy body of the aluminum allloy had a porosity of 60%.

EXAMPLE 3

A powder of barium chloride having a particle size distribution in the range from 2000 to 3400 μm was compacted and sintered in a similar manner to Example 2 into a cylindrical sintered body of a packing density of 65% which was, after preheating at 950° C., i.e. a temperature higher by 147° C. than the critical preheating temperature calculated for the above mentioned packing density and copper used in the subsequent casting, impregnated with molten copper at 1200° C. under pressurization in the same manner as in Example 2 followed by cooling to solidify the melt. The pressurized casting was performed in a mold provided with a heat-insulating liner of ceramic wool to avoid premature solidification of the molten copper and the sintered body of barium chloride was covered with a layer of powdery alumina in a thickness of 5 mm with an object to prevent direct contacting of the melt and barium chloride. Subsequent removal of the barium chloride from the thus obtained composite body by leaching gave a cylindrical spongy body of copper having a diameter of 29 mm and a length of 90 mm of which the porosity was 69%.

EXAMPLE 4

A 400 g portion of a sodium chloride powder having an average particle diameter of 62 μm was spread on a plastic-made pallet and uniformly wetted by spraying 20 g of an aqueous saturated solution of sodium chloride with agitation. A cylindrical mold having an inner diameter of 80 mm and a depth of 150 mm was filled with the thus wetted sodium chloride powder which was then pressed under a load of 20 tons using a hydraulic press. The cylindrical powder compact of sodium chloride weighing 420 g had a diameter of 80 mm and a height of 60 mm, which was then dried in an air oven at 70° C. for 5 hours to give a porous integral mass of sodium chloride weighing 400 g and having a diameter of 79.6 mm and a height of 58.7 mm. The packing density of the salt in this porous body was 64.6%.

The above obtained cylindrical porous body of sodium chloride was put into a metal mold having an inner diameter of 80 mm and a depth of 80 mm and preheated at 525° C. in an electric furnace. The calculated critical preheating temperature was 436° C. for the above mentioned packing density and the aluminum alloy used in the subsequent casting described below. When uniformity of temperature had been obtained over the whole volume of the porous salt body at the preheating temperature, a melt of an aluminum alloy AC3A heated at 700° C. was poured into the mold and immediately pressurized under a load of 15.7 tons on a plunger in a hydraulic press so that the porous body of the salt was fully impregnated with the molten alloy.

After cooling to solidify the molten alloy, the composite body of the aluminum alloy and sodium chloride was taken out of the mold and the salt was leached out and removed by keeping the composite body freed from the crust layer for 24 hours in running water followed by drying. The thus obtained porous spongy body of the aluminum alloy had a porosity of 69% and good permeability to air.

EXAMPLE 5

A cylindrical metal mold having an inner diamter of 80 mm and a depth of 120 mm was filled with 455 g of a sodium chloride powder having an average particle diameter of 62 μm and the salt powder was compacted by compression under a load of about 10 tons to give a cylindrical powder compact having a diameter of 80 mm and a height of 60 mm of which the packing density of the salt powder was about 70%.

This powder compact of sodium chloride was wrapped with a plastic film leaving the upper and lower surfaces unwrapped and an aqueous saturated solution of sodium chloride was poured over the upper surface thereof and percolated through the body from the upper surface toward the lower surface with suction applied at the lower surface to make a pressure difference of about one atmosphere therebetween over a length of time of 1 hour so that the powder compact was fully wetted with the salt solution leaving no unwetted surface of the particles. The wetted powder compact was dried in an air oven at 80° C. for 5 hours to give a porous integral mass of the sodium chloride powder having a packing density of 79%.

The porous integral mass of sodium chloride obtained in this manner was put into a metal mold and preheated at a temperature of 525° C. which was higher by 63° C. than the critical preheating temperature calculated for the above mentioned packing density of the salt and the aluminum alloy used in the subsequent casting described below. When uniformity of temperature had been obtained over whole volume of the porous salt body, a melt of a 12% Si-aluminum alloy heated at 700° C. was poured into the metal mold and pressurized in the same manner as in the preceding example so that the pores of the porous salt body were fully impregnated with the molten alloy.

After cooling to solidify the molten alloy, the thus obtained composite body of the solidified alloy and the salt was taken out of the mold and mechanically worked into blocks each having a diameter of 70 mm and a thickness of 10 mm. The blocks of the composite body were kept in running water for 12 hours so as to leach out the sodium chloride followed by centrifugal dehydration and drying at 80° C. for 2 hours. The porosity of the thus obtained blocks of the porous spongy body of the aluminum alloy was 79%.

EXAMPLE 6

A cylindrical block having a diameter of 100 mm and a height of 100 mm was prepared by compacting 980 g of a sodium chloride powder having an average particle diameter of 50 μm by use of a rubber press and heated in a graphite vessel in an electric furnace at 780° C. for 4 hours to give a cylindrical sintered block of the sodium chloride powder having a diameter of 95 mm and a height of 96 mm. The packing density of the salt in this sintered block was 66%.

This sintered block was put into a mold of cast iron and preheated at a temperature of 500° C. which was higher by 58° C. than the critical preheating temperature calculated for the above mentioned packing density of the salt and the aluminum alloy used in the subsequent casting described below. When uniformity of temperature had been established over whole volume of the sintered salt block, a melt of the same aluminum alloy as in Example 2 was poured into the mold and pressurized up to a pressure of 40 kg/cm$^2$ so as to fully impregnate the pores of the sintered salt block with the melt. After cooling to solidify the molten alloy, the composite block of the salt and the solidified alloy was taken out of the mold and sliced by lathing into 10 disk-like blocks each having a thickness of 8 mm, which were then subjected to the removal of the salt by ultrasonic washing in running water for 3 hours to leach out the salt followed by deaeration under reduced pressure and then by second ultrasonic washing for 30 minutes followed by final drying. The thus obtained disk-like blocks of the porous spongy body of the aluminum alloy had a porosity of 68 to 70%.

Figure 6:
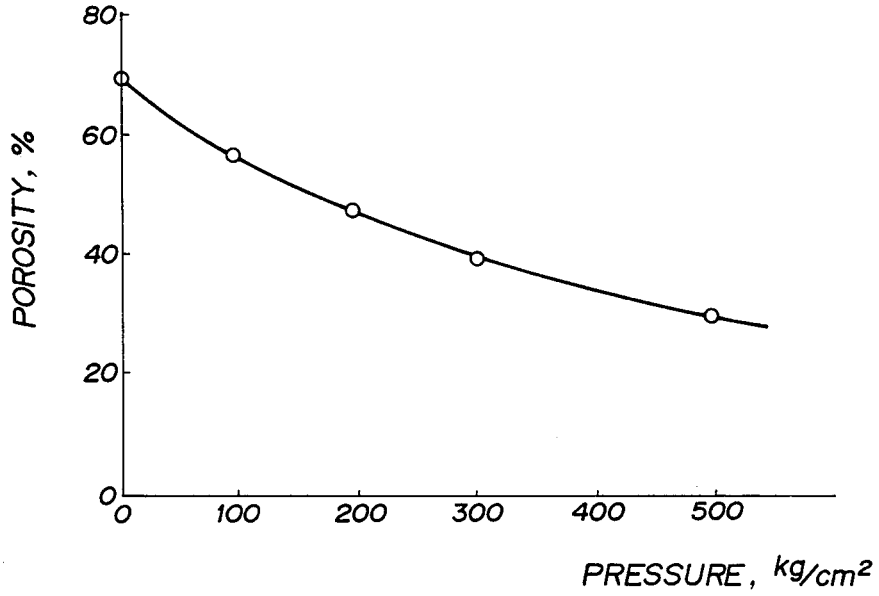
FIGS. 6 and 7 are each a graphic showing of the relationship between the pressure for compression of a porous spongy metallic body and the porosity of the resultant compressed body prepared in Examples 6 and 7, respectively.

Each of the disk-like porous spongy blocks of the aluminum alloy was sandwiched between the upper and lower pressure anvils of a universal testing machine and unidirectionally compressed under a pressure of 100, 200, 300, 400 or 500 kg/cm$^2$. FIG. 6 of the accompanying drawing graphically illustrates the porosity of the thus compressed spongy blocks in % taken as the ordinate as a function of the pressure of compression in kg/cm$^2$ taken as the abscissa. As is understood from this figure, a regular relationship is held between the porosity of the compressed spongy body and the pressure of compression indicating a possibility of reproducibly controlling the porosity of the porous spongy metallic body of the invention.

EXAMPLE 7

A cylindrical sintered body of barium chloride having a diameter of 29 mm and a length of 97 mm with a packing density of 65% was prepared by first filling a cylindrical graphite mold having an inner diameter of 30 mm and a depth of 100 mm with 160 g of the salt powder having an average particle diameter of 300 μm by tapping and then heating the powder compact in the graphite mold at 950° C. for 3 hours in air.

The sintered body was put into a stainless steel-made mold and preheated at 850° C. which was higher by 119° C. than the critical preheating temperature calculated for the above mentioned packing density of the sintered body and the copper-zinc alloy used for subsequent casting described below. When uniformity of the temperature had been established over whole volume of the sintered body, a melt of a 30% zinc-copper alloy at 1100° C. was poured into the mold and pressurized under a pressure of 30 kg/cm$^2$ so as to completely fill the pores of the sintered body of barium chloride with the molten alloy followed by cooling to solidify the melt. The thus obtained composite body of barium chloride and the copper alloy was taken out of the mold and sliced into blocks each having a thickness of about 10 mm which were subjected to complete removal of the barium salt by repeated washing with water, deaeration under vacuum and ultrasonic washing followed by drying into porous spongy blocks of the copper alloy having a porosity of 65 to 67%.

Figure 7:
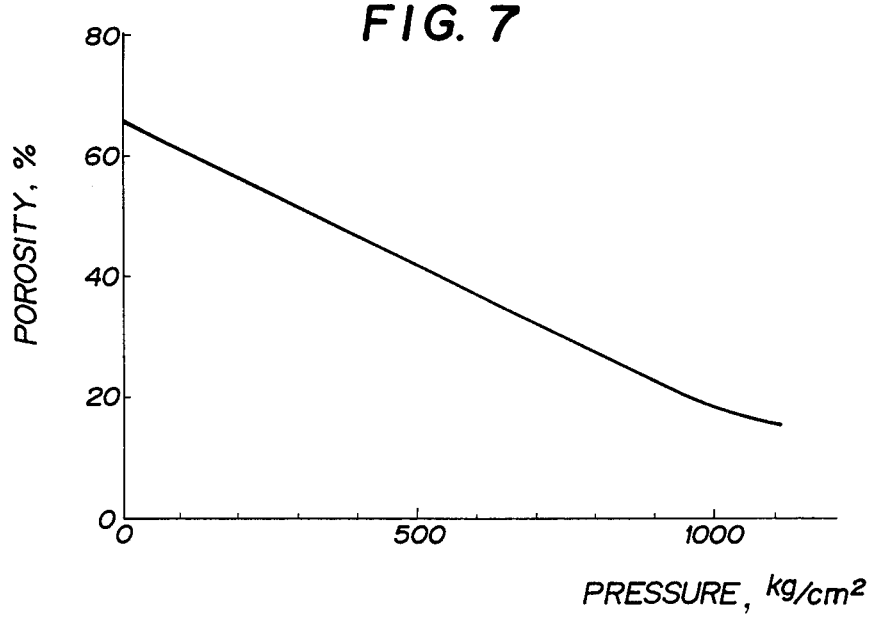

These spongy blocks were compressed in the same manner as in the preceding example each under a pressure of 200 to 1000 kg/cm$^2$ to reduce the porosity. FIG. 7 in the accompanying drawing shows the relationship between the pressure for compression and the porosity of the resultant spongy blocks thus obtained. Even the block compressed under the largest pressure was found to retain the open cell structure as indicated by the air permeation test in which the air pressurizing one of the surfaces of the block could pass through the body to the other surface without noticeable increase in the resistance against air permeation.

What is claimed is:

1. A method for the preparation of a porous spongy body of a metal or alloy having an open cell structure which comprises the steps of:

(a) compacting a powder of an inorganic compound soluble in at least one solvent and having a particle size distribution in the range from 10 to 5000 μm into a form of powder compact;

(b) forming interconnections at least partly bridging the particles in the powder compact to form a porous integral mass of which the volume fraction of the inorganic compound is $V^P$:

(c) preheating the porous integral mass at a preheating temperature $T^P$ which is lower than the melting point of the inorganic compound and between the solidification temperature of the metal or alloy $T^M$ and a critical preheating temperature $T^C$ defined by the equation $$T^C = T^M - 0.25(H^M \cdot D^M / V^P \cdot C^P \cdot D^P),$$

in which $H^M$ is the latent heat of solidification of the metal or alloy in calories/g, $D^M$ is the density of the metal or alloy in g/cm$^3$, $V^P$ is the volume fraction of the inorganic compound in the porous integral mass, $C^P$ is the specific heat of the inorganic compound in calories/g.°C. and $D^P$ is the true density of the inorganic compound in g/cm$^3$, all temperatures being given in °C.;

(d) filling the pores of the porous integral mass of the inorganic compound with a melt of the metal or alloy to form a porous mass impregnated with the melt of the metal or alloy;

(e) cooling the thus impregnated mass to solidify the melt of the metal or alloy into a composite body of the inorganic compound and the solidified metal or alloy; and (f) removing the inorganic compound from the composite body by dissolving away with a solvent capable of dissolving the inorganic compound to leave the metal or alloy in a spongy form.

2. The method as claimed in claim 1 wherein the interconnections bridging the particles of the inorganic compound are formed by subjecting the powder compact to sintering.

3. The method as claimed in claim 1 wherein the interconnections bridging the particles of the inorganic compound are formed by wetting the surfaces of the particles with a saturated solution of the inorganic compound in a solvent and then evaporating the solvent to dryness to precipitate the inorganic compound contained in the saturated solution.

4. The method as claimed in claim 1 wherein the volume fraction $V^P$ of the inorganic compound in the porous integral mass obtained in the step (b) is in the range from 0.50 to 0.85.

5. The method as claimed in claim 1 wherein the inorganic compound soluble in at least one solvent is a compound soluble in water.

6. The method as claimed in claim 3 wherein the surfaces of the particles are wetted with the saturated solution of the inorganic compound prior to compacting of the powder of the inorganic compound into a powder compact.

7. The method as claimed in claim 3 wherein the surfaces of the particles are wetted with the saturated solution of the inorganic compound by infiltrating the powder compact with the saturated solution.

8. The method as claimed in claim 1 wherein the pores of the porous integral mass are filled with the melt of the metal or alloy in the step (d) under pressurization with a pressure in a range of 30–100 kg/cm$^2$.

9. The method as claimed in claim 1 wherein the inorganic compound is removed from the composite body in the step (f) by dissolving away with the solvent under ultrasonic waves.

10. A method for the preparation of a porous spongy body of a metal or alloy having an open cell structure with a controlled porosity which comprises the steps of:

(a) compacting a powder of an inorganic compound soluble in at least one solvent and having a particle size distribution in the range from 10 to 5000 μm into a form of powder compact;

(b) forming interconnections at least partly bridging the particles in the powder compact to form a porous integral mass of which the volume fraction of the inorganic compound is $V^P$;

(c) preheating the porous integral mass at a preheating temperature $T^P$ which is lower than the melting point of the inorganic compound and between the solidification temperature of the metal or alloy $T^M$ and a critical preheating temperature $T^C$ defined by the equation $$T^C = T^M - 0.25(H^M \cdot D^M / V^P \cdot C^P \cdot D^P),$$

in which $H^M$ is the latent heat of solidification of the metal or alloy in calories/g, $D^M$ is the density of the metal or alloy in g/cm$^3$, $V^P$ is the volume fraction of the inorganic compound in the porous integral mass, $C^P$ is the specific heat of the inorganic compound in calories/g.°C. and $D^P$ is the true density of the inorganic compound in g/cm$^3$, all temperatures being given in °C.;

(d) filling the pores of the porous integral mass of the inorganic compound with a melt of the metal or alloy to form a porous mass impregnated with the melt of the metal or alloy;

(e) cooling the thus impregnated mass to solidify the melt of the metal or alloy into a composite body of the inorganic compound and the solidified metal or alloy;

(f) removing the inorganic compound from the composite body by dissolving away with a solvent capable of dissolving the inorganic compound leaving the metal or alloy in the form of a porous spongy body; and (g) compressing the porous spongy body of the metal or alloy under a pressure to such a controlled extent that the porosity of the porous spongy body is substantially decreased.

11. The method as claimed in claim 10 wherein the pressure for compression is in the range from 100 to 1000 kg/cm$^2$.

* * * * *